United States Patent [19]

Greer et al.

[11] 4,345,244

[45] Aug. 17, 1982

[54] VIDEO OUTPUT CIRCUIT FOR HIGH RESOLUTION CHARACTER GENERATOR IN A DIGITAL DISPLAY UNIT

[75] Inventors: Douglas S. Greer, San Diego, Calif.; Paul Grunewald, Somerset, N.J.

[73] Assignee: Burroughs Corporation, Detroit, Mich.

[21] Appl. No.: 178,494

[22] Filed: Aug. 15, 1980

[51] Int. Cl.[3] ..... G09G 1/16

[52] U.S. Cl. ..... 340/728; 340/744; 340/799

[58] Field of Search ..... 340/724, 728

[56] References Cited

U.S. PATENT DOCUMENTS

| | | | |
|---|---|---|---|
| 3,868,672 | 2/1975 | Johnson | 340/724 |
| 3,918,040 | 11/1975 | Beuter et al. | 340/724 |
| 4,079,367 | 3/1978 | Yonezawa et al. | 340/728 X |
| 4,095,216 | 6/1978 | Spicer | 340/728 |
| 4,119,954 | 10/1978 | Seitz et al. | 340/728 |

*Primary Examiner*—David L. Trafton

*Attorney, Agent, or Firm*—Mervyn L. Young; Kevin R. Peterson

[57] ABSTRACT

This disclosure relates to a video output circuit for high resolution character generation in a digital display unit. This output circuitry includes both character generation circuits and logic circuits, the latter of which fills in information bit areas adjacent to character bit areas which form a diagonal so as thereby to round out the character being displayed. In addition, the circuitry is adapted to change the position of such characters on the display screen so as to provide superscripts and subscripts as well as provide characters which are higher and wider than the normal character display. In order to minimize time lags in the generation display of such characters, the output circuitry is provided with a series of registers so that the character generation can be received in a sequential or pipelined manner.

10 Claims, 14 Drawing Figures

VIDEO OUTPUT CIRCUIT FOR HIGH RESOLUTION CHARACTER GENERATOR IN A DIGITAL DISPLAY UNIT

RELATED U.S. PATENT APPLICATIONS

U.S. patent applications directly or indirectly related to the subject application are the following: Ser. No. 178,519, filed Aug. 15, 1980 by A. Berracasa et al and entitled "Line Buffer Circuit for High Resolution Generator in a Digital Display Unit".

BACKGROUND OF THE INVENTION

1. Field of the Invention

This invention relates to high resolution generators for digital display units and more particularly to a video output system for such units.

2. Description of the Prior Art

New applications are being increasingly found for display units coupled to a data processing system. Such display units may be custom made for such purposes or may be formed of conventional commercial television sets. In either case, the information displayed is usually of the nature of characters formed of a dot matrix where the display unit employs a raster scan mode. Each horizontal line is divided into a number of discrete points or areas called picture elements (PELS) or pixels. A fraction of such picture elements per line is not employed for information display but is that portion of the scan time required for horizontal retrace and synchronization of the horizontal oscillator.

As the display screen is scanned, the dot matrix characters are formed by character generation circuits that control the modulation of the electron beam (in the case of CRT displays), individual circuits of which are selected by character codes that are stored in a memory. This code store can be a shift register with exactly the same number of cells as there are character positions on the display screen, or it may be a random access memory.

In some display units, 25 to 30 complete scans of all the lines making up the display are made per second. Thus, each portion of a character being displayed is on display 25 to 30 times a second for a brief period and this can cause an apparent flickering. The flickering problem is normally solved by refreshing or redrawing all the lines in the display in two consecutive interlaced scans. A "half-scan" is redrawn or refreshed in half the time. Because of the 2:1 interlace between the two half-scans, if a horizontal line is drawn in one half-scan and is adjacent to a line drawn in the next half-scan, the two form a line on the display screen with reduced flicker because, in essence, it is written twice as often. Applying this knowledge, a $6\times8$ dot matrix character can be displayed on a $12\times16$ dot matrix, by displaying each dot in the $6\times8$ matrix four times. This reduces the flicker considerably, as the character now seems to be written 50 to 60 times a second, instead of 25 to 30 times. However, this results in an objectionable feature in that diagonal lines have a ragged appearance and "included" corners are not provided. This ragged appearance becomes more pronounced if the characters are displayed with a finer resolution than that with which they are stored in the character generator store.

A particular solution to the flicker and ragged character appearance is provided by the Seitz et al U.S. Pat. No. 4,119,954 which is directed toward a display system adapted for commercial video monitors with interlaced scans wherein circuitry is provided to sense the lack of an information bit in areas adjacent to dot character areas, which areas form a diagonal, and to fill in those diagonal adjacent areas so as to thereby give the displayed character a smooth appearance. In the Seitz et al patent, the information is supplied serially in digital form to a digital-to-analog converter for presentation of the final composite video signal. The serial nature of such a system presents a time lag when it is desired to display a number of characters in a relatively short period of time.

Such time lag can be overcome by the implementation of the algorithm of the Seitz et al patent by parallel circuitry. Furthermore, the character code supplied to the code generation circuitry should be arranged in sequence for presentation to that circuitry and to this end, line buffering or storage is required.

It is, then, an object of the present invention to provide an improved information display unit which is flicker-free and in which displayed characters do not have a ragged appearance.

It is another object of the present invention to provide a flicker-free display unit for digital information which displays relatively smooth characters with reduced time lag in the display of those characters.

It is still another object of the present invention to provide a high resolution character generation circuitry for a display unit, which display unit is provided with line buffering for the presentation of character codes to the generation circuitry in consecutive sequences.

SUMMARY OF THE INVENTION

In order to achieve the above-identified objects, the present invention is directed toward character generation circuitry including logic circuitry between the character generator and the display unit. The logic circuitry fills in information bit areas adjacent to character bit areas which form a diagonal so as thereby to round out the character being displayed. Furthermore, the character generation circuitry is arranged so as to receive the character codes which specify the character generation, in a parallel manner, thereby minimizing time lags.

DESCRIPTION OF THE DRAWINGS

The above and other objects, advantages and features of the present invention will become more readily apparent from a review of the following specification when taken in conjunction with the drawings wherein.

GENERAL DESCRIPTION OF THE INVENTION

Figure 1:
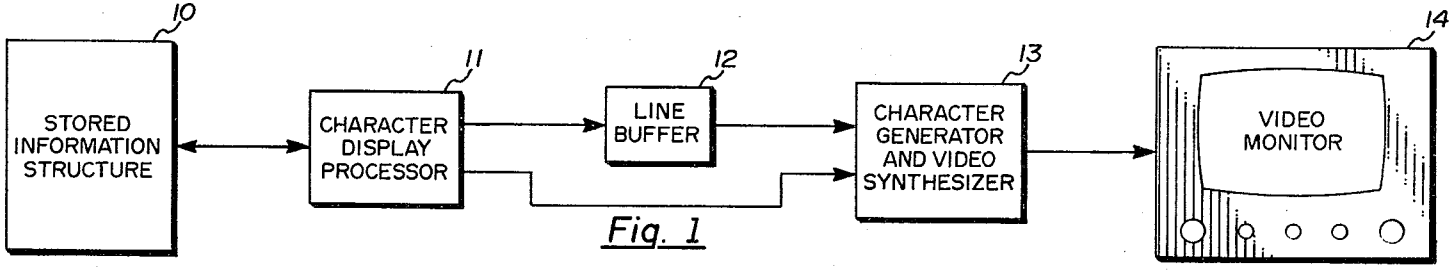
FIG. 1 is a diagram of a display system employing the present invention.

A digital display system of the type employing the present invention is illustrated in FIG. 1. As shown therein, stored information structures are fetched from information storage 10 by character display processor 11 which controls the communication between storage 10 and the present invention. Character codes from the display processor 11 are received by line buffer 12 for sequential presentation to the video output circuit 13. As indicated in FIG. 1, video output circuit 13 includes both the character generation circuitry and the video synthesization circuitry as will be more fully described below. The system of the present invention is adapted to provide video signals to a commercial video monitor 14.

The picture on display monitor 14 is refreshed or redrawn a number of times per second, 25 to 30 times per second in the embodiment of the present invention. For this reason, there has to be a storage for the information to be displayed during each scan of the display. Line buffer 12 of FIG. 1 provides this capability. The display area of the television screen can be divided into a coordinate system which, in the embodiment being described, has 640 picture elements on a horizontal line and 480 lines in the picture. If a chosen character set were to contain, for example, characters 8 picture elements wide and 16 lines high, the character position counter would divide the screen into 80 character positions horizontally and 30 character lines vertically for an $80\times30=2{,}400$ characters to be displayed.

Figure 2C:
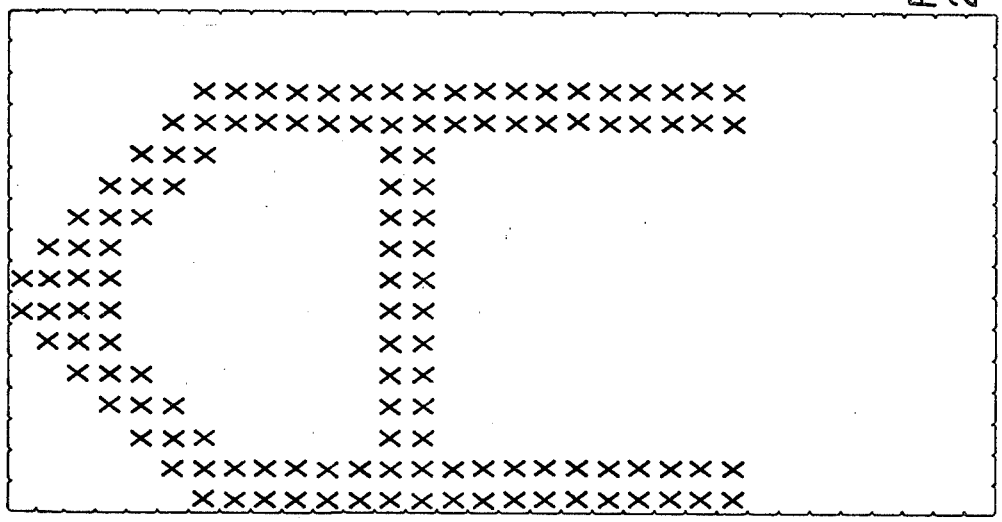
FIGS. 2A–F represent a character in different modes of display by a system employing the present invention.
Figure 2B:
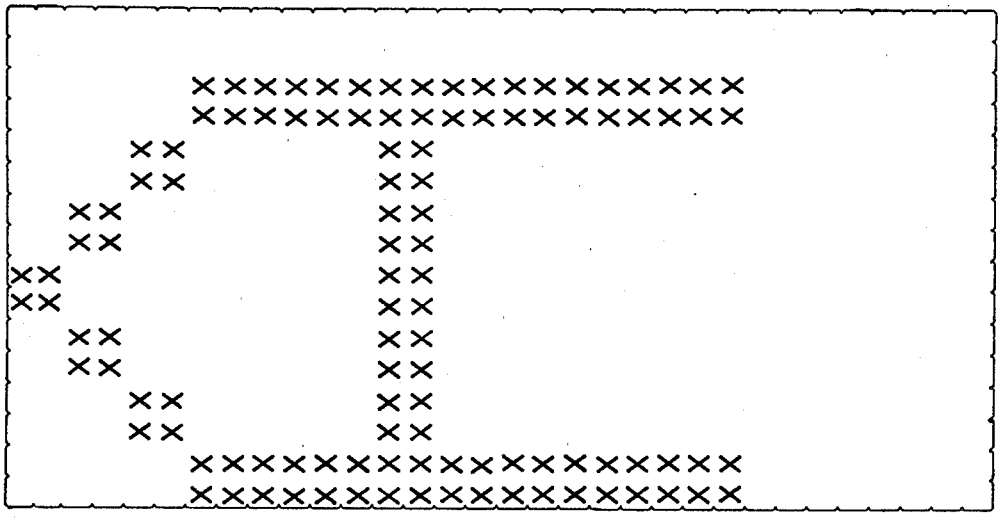
Figure 2A:
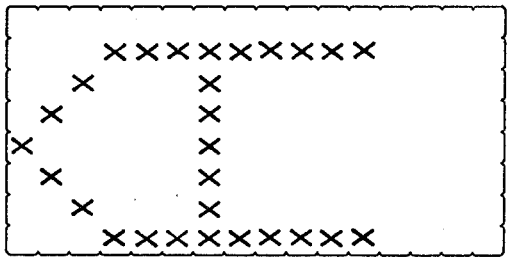

The character generator of the present invention generates the signals for each character dot-matrix pattern. For a brief explanation of this pattern, reference is now made to FIG. 2A which illustrates, as an example, the dot-matrix pattern for the letter "A". The dot-matrix, in this example, is an area of 16 rows of 8 picture elements each. The character "A" is defined by those areas marked with "X's" which represent the picture element on the display screen that will be activated during the character generation or appear as light dots on the display screen with the blank areas in FIG. 2A representing dark dots or inactivated areas. The character created on the display screen is represented by the dark and light areas according to the character pattern.

As was indicated above, it is common to employ an interlaced scan in a commercial television display to reduce the flickering of that information as it is seen by the viewer. To this end, the individual character information generated by the character generator circuitry is displayed four times. Thus, an $8\times16$ character such as illustrated in FIG. 2A becomes a $16\times32$ character dot-matrix as illustrated in FIG. 2B. FIG. 2B appears to be ragged because of the lack of informational bits as illustrated in FIG. 2B of the areas denoted by diagonal lines 15A–F. Because of the display of each informational bit four times, this results in the exclusion of "included" corners. The present information is adapted to provide informational bits to adjacent areas whenever "included" corners are to occur. This results in the display of a character as illustrated in FIG. 2C.

Figures 2D, 2E, 2F:
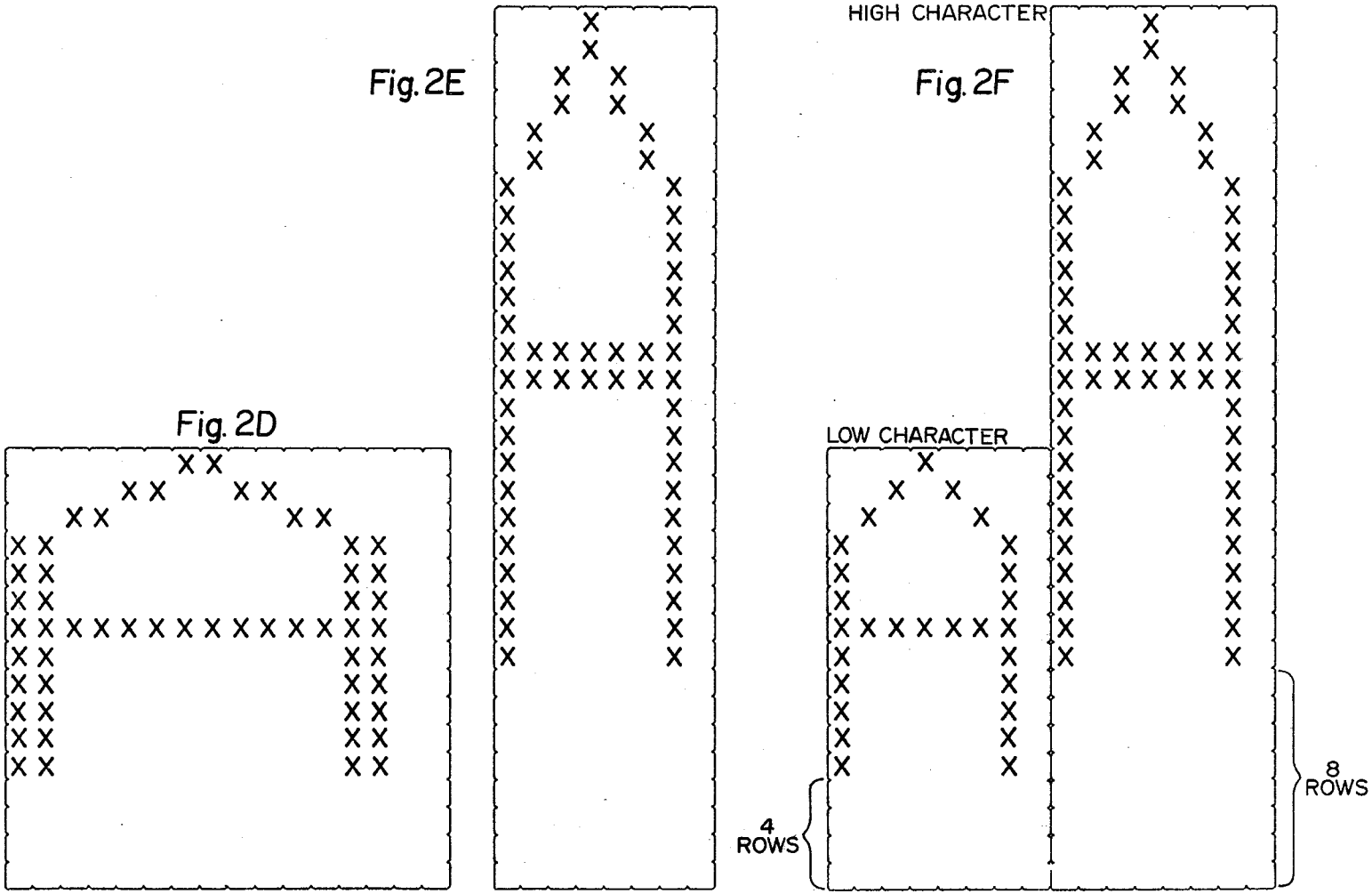

The video output circuit of the present invention generates four character sizes depending on two status bits, high and wide, of the status code which precedes the character code and specifies the mode in which the character is to be displayed. If both of these bits are zero, a normal sized character with eight columns and 16 rows is generated as illustrated in FIG. 2A. If the wide bit equals one, a double-width character is produced as illustrated in FIG. 2D. FIG. 2E illustrates a character with the high status bit equal to one and the wide status bit equal to zero, which causes each picture element to be repeated in the vertical dimension, and thus produces a character with eight columns and 32 rows. When both the high and wide status bits equal one, a character with 32 rows and 16 columns is generated.

A row address is also provided to the video output circuitry to specify the start of each horizontal line. The row address is used with the status bits for the highlights: superscript, subscript, and high, to determine which horizontal row of the character font is output for the present scan line. FIG. 2F shows the positioning of high and low characters if no vertical shifting is used. The character base line for the low character shown in FIG. 2F is four rows above the bottom row. Consequently, the corresponding high character base line is eight rows from the bottom. If the high and low characters are combined on the same character line, the base lines should be on the same row. This is accomplished by the present invention either by shifting low characters up four rows or shifting high characters down four rows.

FIG. 2F shows consecutive row locations as they could appear on the display monitor. However, it is important to remember that each frame is composed of two interlaced fields. Consequently, the row address is normally incremented by two between consecutive lines of video output. This is necessary since every other line must be passed over, and filled in later, during the generation of the alternate field.

Other highlights can be specified by appropriate bits in the status code. The Bright and Reverse bits control the intensity levels assigned to the foreground and background shades. These four combinations include various combinations of gray, black and white for both the foreground and background. When the Underline status bit is set, the two scan lines below the character are set to the foreground shade for that character. The Blink or Invisible bit causes the entire character, including the underline, to be displayed as a background shade. When the Secure bit is set, all pixels within the character area are displayed as a foreground shade. This highlight has no effect outside the character area, or if the Blink bit is enabled. Finally, the setting of the cursor bit reverses all pixels within the character area, i.e., pixels of the background shade are displayed as foreground shade and vice versa.

In addition, smaller characters can be stored in such a way that their display will include additional information bits for alternate scan lines.

Figure 3:
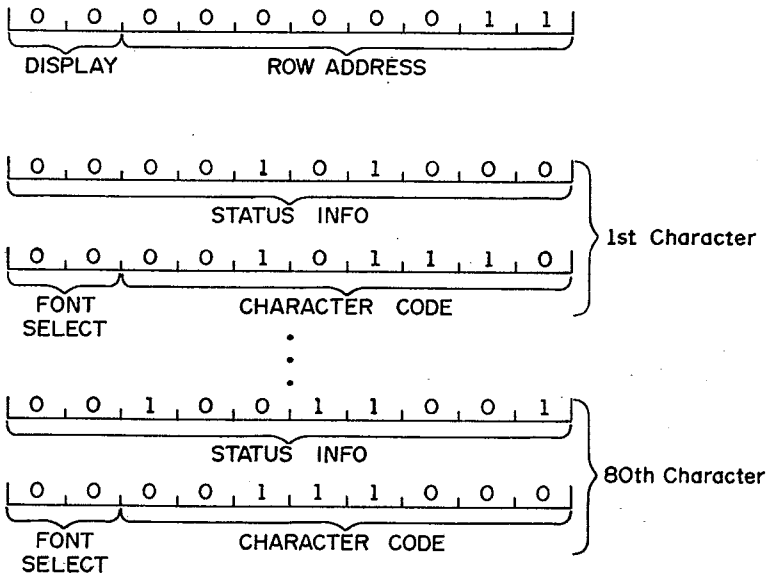
FIG. 3 is a set of diagrams illustrating the data stream formats of the present invention.

FIG. 3 illustrates the formats of the various codes which make up the data stream to the video output circuit. These formats include row address as well as the status code and character code for each character in a sequence.

DETAILED DESCRIPTION OF THE INVENTION

Line Buffer Circuit

Figure 4:
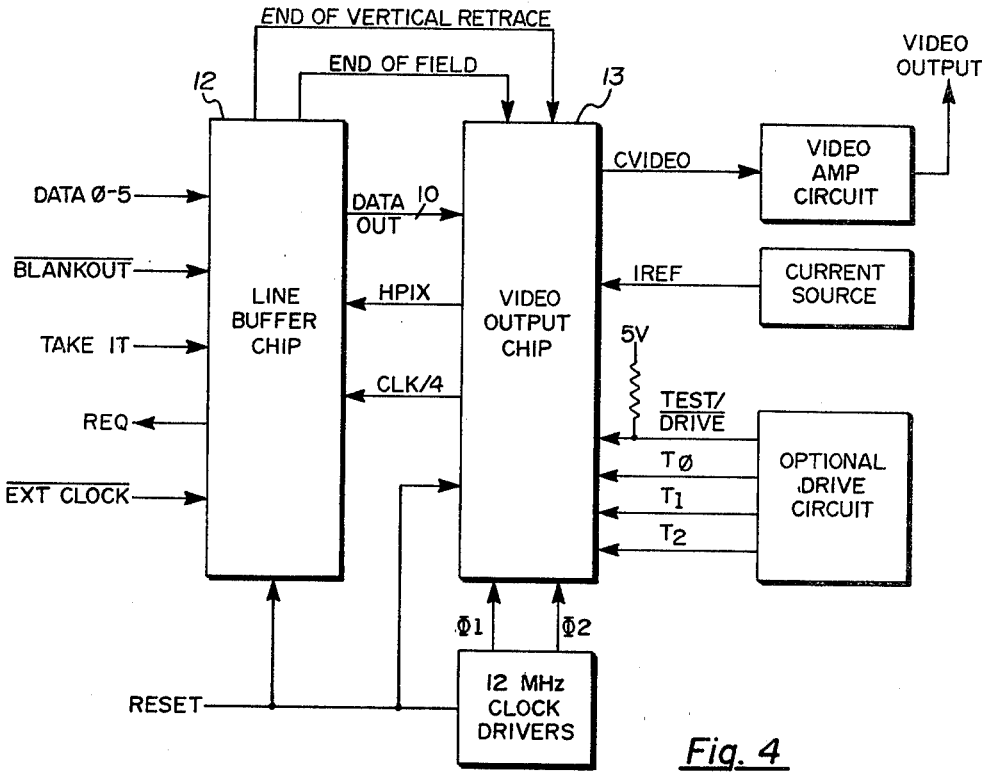
FIG. 4 is a diagram representing the relation between the line buffer circuit and a video output circuit of the present invention.

FIG. 4 illustrates the signals the line buffer circuit uses to communicate with the rest of the system. The rate at which the 17 input signals, DATA 0-15, and BLANKOUT are shifted into the circuit is dependent upon both the frequency of the external clock and the readiness of the line buffer circuit to accept new data. The readiness is characterized by the state of the REQUEST (REQ) signal. On the output side of the circuit, information is transferred to the video output circuit in 10-bit quantities at a rate exactly equal to the pixel rate divided by four. Synchronization with the video monitor is made possible through the horizontal sync signal HPIX whose main purpose is to bracket the activity part of the video scan line. The RESET line shown in FIG. 4 is common to the whole video system synchronization during power-up. Finally, two other output leads are assigned to the END OF FIELD and END OF VERTICAL RETRACE signals.

The storage or line buffers (to be described below) are implemented as two 80×20 sequentially accessed memories (SAM's), 19A and 19B of FIG. 5. Each 20-bit word fully describes one of the 80 displayable characters. Eight bits of the character code address the character font of the video output circuit to select one of 256 characters, along with two "Font Select" bits to allow selection of a particular video output circuit. Ten bits of the status (or "highlight") information contribute to the general appearance of the character such as its size, brightness, position relative to the character line, background shade, and so forth.

Given a particular character line, the same sequence of 80 pairs of data is sent to the video output circuit for each scan line. These 160 transfers take place within 160 clock/four periods, and are preceded by a 10-bit row address which specifies which row of the character dot-matrix is to be displayed on the present scan line.

The data must be read from the line buffer a number of times equal to the scan line pairs for that particular character line. At the end of every scan line, the register holding the row address is incremented and points to the next scan line to be displayed.

One line buffer is either full, or being filled up (i.e., written into) while the other line buffer is being used for display (i.e., read from). After a given character line has been displayed, the line buffer holding data for the next character line to be displayed must be full, which is a system constraint, and the line buffer previously used for display starts accepting data for the following character line.

Communication on the input side of the line buffer circuit is attained by two signals, REQUEST and TAKE IT. Whenever the line buffer circuit is empty and can accept a new character, it raises its REQUEST signal and keeps it high until TAKE IT signal goes high, at which time a new set of data on the data input lines is strobed into an input latch. At this time, the line buffer circuit is able to process that particular character immediately and keeps its REQUEST signal high for another clock period, indicating it can process a second character right away. However, no more than two characters can be processed consecutively. At this time, the line buffer circuit is unable to process another character. This is characterized by the REQUEST signal's going low after the second set of data has been strobed in.

A 17-bit data word is strobed into the circuit on a positive clock edge whenever both REQUEST and TAKE IT are high simultaneously.

In the case where characters are readily available all the time, the TAKE IT signal remains high while characters are strobed in on every other rising edge of the external clock. Conversely, the ability of the line buffer circuit to process characters faster than it receives them is characterized by short TAKE IT pulses separated by long time intervals and the REQUEST signal's staying high.

Because of the nature of the video signal production, and its need to be compatible with television standards, the output signals of the system must be supplied constantly at the video frequency. The input process is synchronous with respect to a second clock source called external clock. This is done for several reasons. One reason is for versatility in speed. Provision for faster interfacing of devices with the main store (i.e., higher input/external clock rate) improves the overall throughput of the line buffer circuit to allow for narrower character lines. A second reason is synchronization. The present invention does not have the need to synchronize every data transfer. Instead, clock synchronization takes place once per character line when the line buffer becomes full and starts to read out data at the output clock rate.

Figure 5:
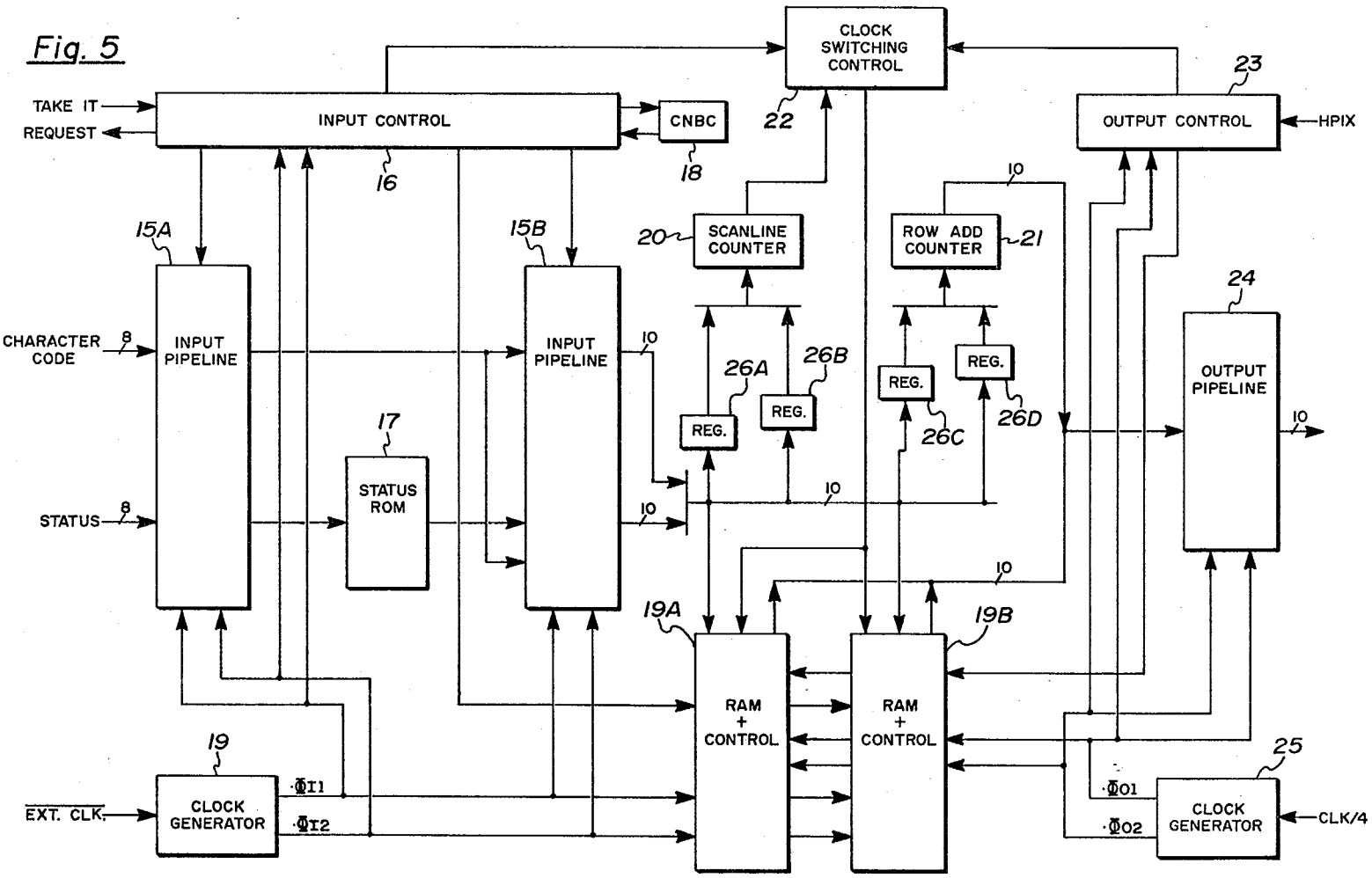
FIG. 5 is a schematic diagram of the line buffer circuit of the present invention.
Figure 6:
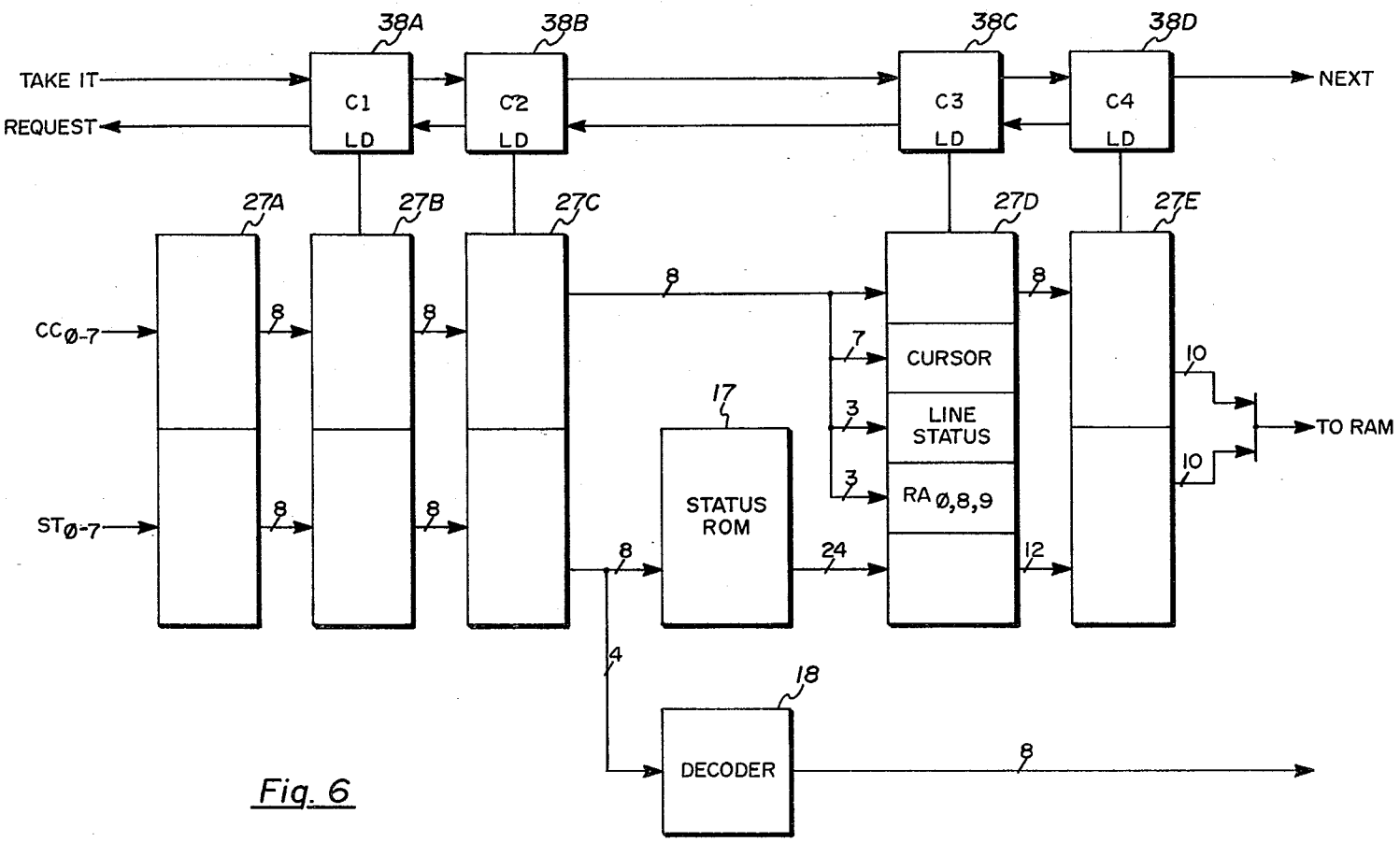
FIG. 6 is a schematic diagram of an input pipeline circuit of FIG. 4.

The data transfer rate through the input pipeline of FIG. 5 is controlled by the input controllers 28A . . . D, as illustrated in FIG. 6. These controllers generate loading signals into the various stages of the pipeline as a function of the availability of the data from the previous stage as well as the delay through the various logic. The first bank of registers 27A of FIG. 6 at the beginning of the pipeline catches data on every rising edge of the external clock. Controllers 28A and 28B generate load signals for the next two stages, making it possible to strobe in two segments of information in two consecutive clock periods. The maximum propagation delay through status ROM 17 is one and one-half ($1\frac{1}{2}$) periods of the external clock. Controller 28C generates a single load signal which, when gated with one of the bits, T0–T7, provides the strobe input to load the appropriate destination register. After the data are clocked into the fourth stage of the pipeline, a 20-bit character code/status word has been built and is ready to be loaded into the line buffer itself. The timing signals for this final stage are provided by controller 28D.

In FIG. 4 there is illustrated an input signal that is described as BLANKOUT. This signal is required for the line buffer circuit to comply with all system configurations used in the present application. If left unconnected, this signal is internally pulled high. If, however, this signal is pulled low, then the corresponding character code associated with that transfer is forced to represent a space or a blank. That character code, however, is a programmable option and can be specified to be any eight-bit code. When BLANKOUT is asserted, the highlight bits are left unchanged. For example, if the character is originally to be underlined, the result is an underlined blank character.

Figure 7:
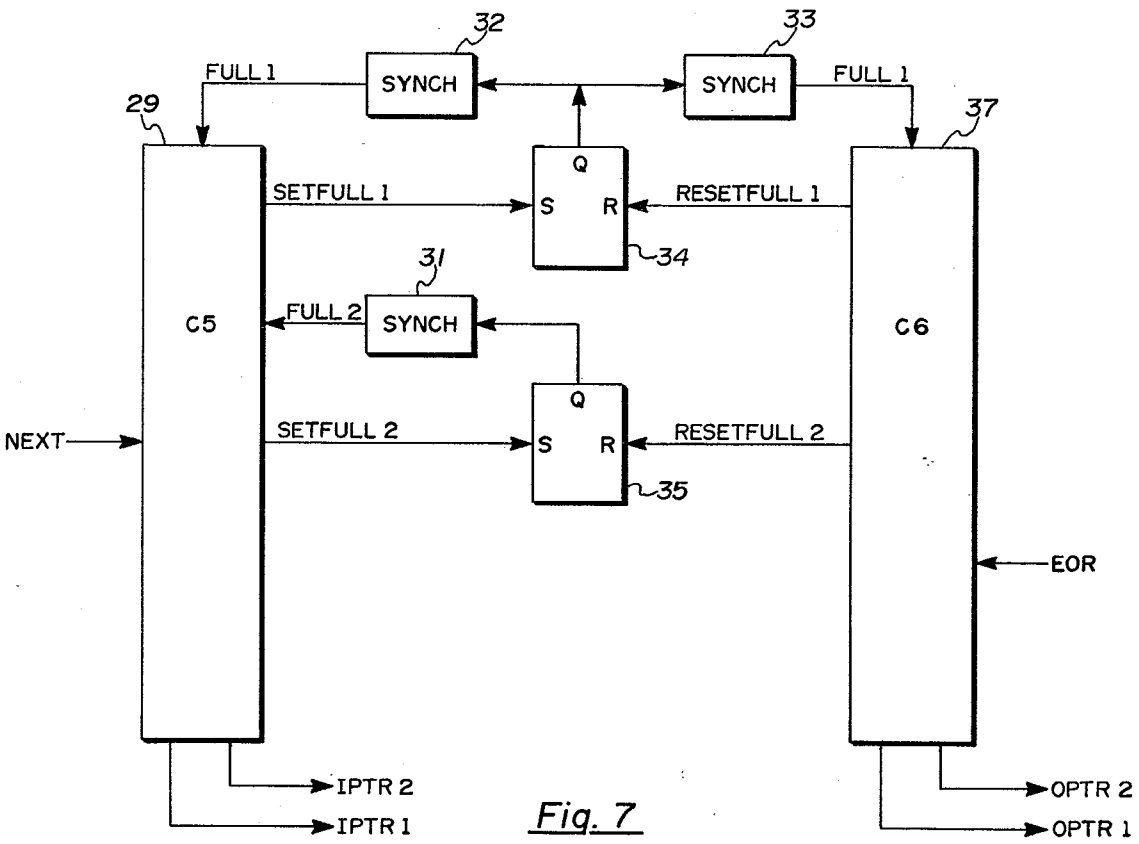
FIG. 7 is a schematic diagram of the clock switching circuit of FIG. 4.

The clock switching circuit of FIG. 5 is illustrated in detail in FIG. 7. It serves to generate the input pointers (IPTR 2, IPTR 1) amd output pointers (OPTR 2, OPTR 1) which define which line buffer is presently being written into or read from. Upon completion of a character line, the signal called NEXT goes high, indicating to the input controller 29 that the line buffer is full. That controller then sets the appropriate FULL flip-flop and waits for the next available buffer. As soon as the buffer becomes available, IPTR 2 and IPTR 1 are changed to represent which line buffer is presently being filled up. In a similar fashion, output controller 37 receives an end-of-read signal, EOR, at the end of the last scan line for a given character line. Immediately thereafter, output controller 37 resets the corresponding FULL flip-flop and assigns new values to OPTR 2 and OPTR 1 which point to the next buffer used for display.

The R/S flip-flops 34 and 35 shown in FIG. 7 store the line buffer state of either full or not full. Because they are set and reset by asynchronous signals, their outputs must be synchronized with the external clock or output clock before they can be used as inputs to controllers 29 or 37 respectively. This synchronization is performed by the respective synchronization circuits in FIG. 7.

Returning to FIG. 5, the respective line buffers 19A and 19B are organized as 80×20 bit sequential access memories. They are addressed through an 80-bit shift register which shifts a single "1" enabling sequential word lines. The refreshing circuitry is contained within the memory block and runs at a clock/four rate. READ ENABLE and WRITE ENABLE signals are generated from the display controller and controller 28D of FIG. 6 respectively.

Also provided as a part of the input structure is a 240×24 status ROM 17, a 1 of 8 decoder, and four state machines. These serve to provide a system interface through REQUEST and TAKE IT signals, load signals into the four stages of the input pipeline, and WRITE ENABLE signals into the respective SAM's.

Counter 18 is a special counter which counts the number of characters being written into the SAM. After 80 writes, counter 18 signals controller 28D of FIG. 6 that 80 characters have been written into the line buffer. If less than 80 characters have been written into the line buffer, counter 18 insures that the remaining portion of the line buffer will be filled with blank characters.

Scan line counter 20 provides the holding and counting portions of the scan line circuitry. Each character line needs its own scan line count and the counting logic can be multiplexed between the two line buffers, with separate eight-bit registers to hold the initial scan line count. The output of scan line counter 20 is a single "ripple carry". It goes high as the last scan line of each character line is displayed.

Row address counter 21 serves to monitor which row of the character dot-matrix is being displayed at the present scan line. In the case of interlaced raster displays, every other scan line is displayed in the odd field, and the remaining scan lines are displayed in the even field. Therefore, the row address counter must be incremented by two while one is being added to the scan line counter which keeps track of the number of scan line pairs per character line.

Output controller 23, which is also referred to as the display controller, is a state machine which accepts the horizontal sync signal for an input and generates four timing signals to mark the beginning or end of a line. It also sets the rate at which character code/status pairs are retrieved from the SAM.

Output pipeline 24 holds the data for transmission to the video output circuitry from the line buffer circuitry. After the system power-up and until a line buffer circuitry completely fills the line buffer, no information is available for display. During that time, bits five, eight and nine of the output are forced high to force the video output circuitry to generate the vertical retrace sequence. The effect is to keep the video monitor screen blank until valid information is available for display. The output pipeline's principal function is to buffer the data.

As was indicated above, a feature of the present invention resides in the ability of the line buffer circuit to accept data signals from an outside source, which signals are driven by an external clock, and to send those data signals on to the video output circuit at the rate of an internal or video clock. This is accomplished by providing a clock switching circuit so that the two line buffers or SAM storages which are to receive the data from the outside source can be driven by the external clock when one of those buffers is to receive data; and then to switch the appropriate buffer to the internal or video clock when it is to supply data to the video output circuit. In this manner, each line buffer or SAM storage can be switched from the external clock to the internal clock as required.

Video Output Circuit

Figure 8:
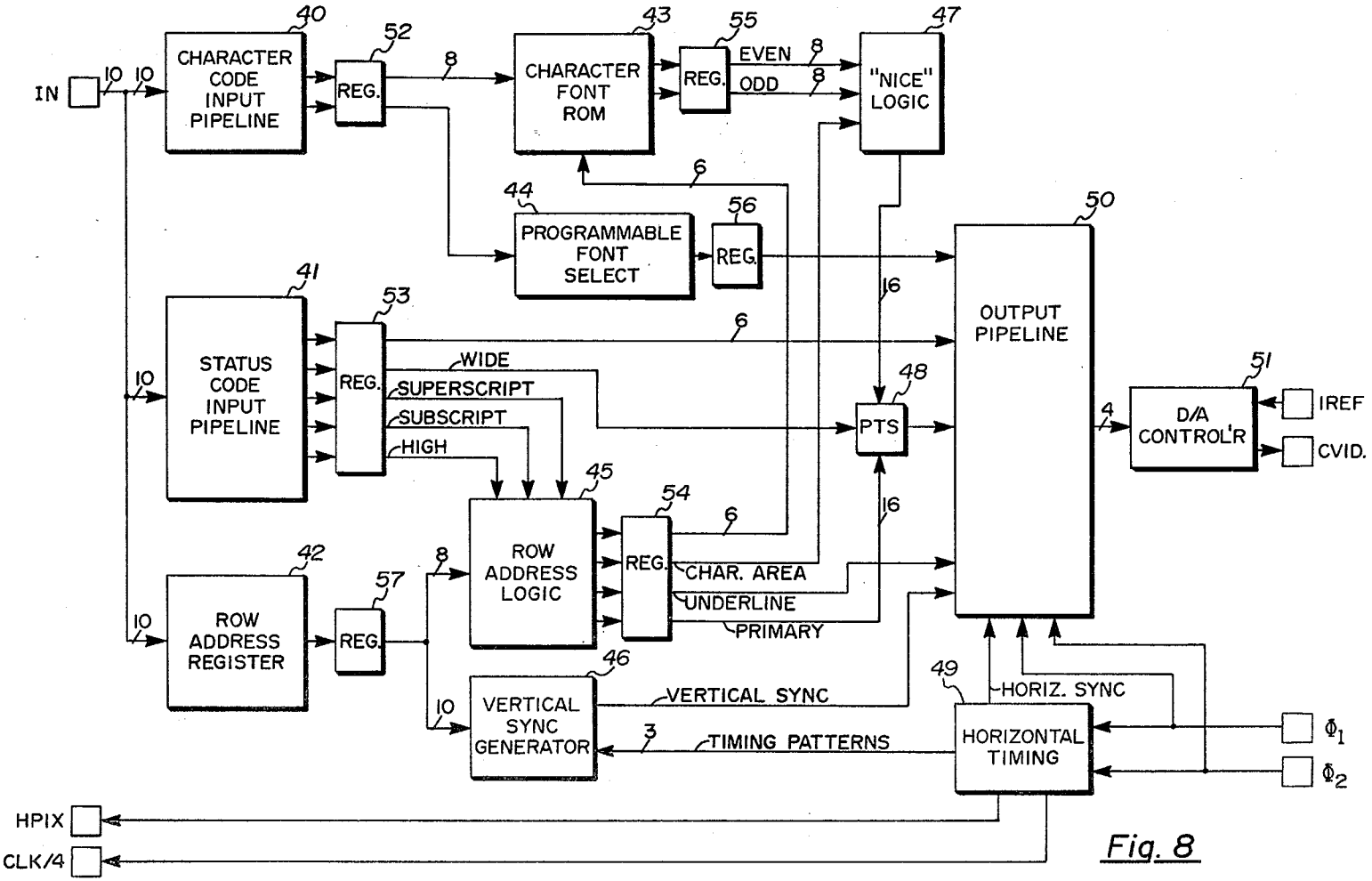
FIG. 8 is a schematic diagram of the video output circuitry of the present invention.

The video output circuit of the present invention is illustrated in FIG. 8. As shown therein, the received data signals are either a row address, a status code, or a character code, and are sent respectively to row address register 42, status code input pipeline 41 and character code input pipeline 40. The respective input pipelines 40 and 41 are shift registers whose sole function is to delay the incoming data for 18 video clock cycles.

Row address register 42 is to receive and hold the row address at the beginning of each scan line. This address is used for the entire line to either select the proper vertical sync pattern or as the base offset in character row addressing. Row address logic 45 contains a 40-bit ROM and adder circuitry (as was described above in relation to FIGS. 2A–F.) Logic is also provided in this circuitry to determine if the current now address is within the character area or the underlined area of the character to be displayed. The six address bits used by character font ROM 43 are generated from the effective row address.

Programmable font select circuitry 44 compares the two high order bits of the 10-bit character code with two mask-programmed bits to determine if the selected character is contained within the character ROM 43 of the present video output circuit. If it is not, a sync level output is generated which allows another video output circuit to drive the video output amplifier. As was indicated above, a plurality of video output circuits of the present invention can be driven from the line buffer circuitry described above.

"Nice" logic 47 contains the circuitry to provide the "included corners" which is a feature of the video output circuitry and was described above. If the current character to be displayed is neither a high character and a wide character such that the "nice" feature is desired, logic circuitry 47 has no effect other than passing the character font data on to parallel-to-serial converter 48. If the character is both high and wide and a mask-programmable "nice-enable" register (not shown) is set true, this circuitry fills in the "missing corners".

Parallel-to-serial converter 48 accepts 16 bits in parallel from "nice" logic circuitry 47. If it has been determined that this character is to be displayed as a wide character, these bits are shifted out serially during the next 16-bit clock cycles. If it is determined that the character is not to be displayed as a wide character, circuitry 48 "double shifts", causing every other bit to be shifted out during the next eight clock cycles.

Output pipeline 50 receives the serial output of parallel-to-serial converter 48 and combines that serial data with various status/highlight signals and timing inputs to generate the four output signals that are to be sent to digital-to-analog converter 51. Also contained within the output pipeline 50 is various testing and monitoring logic associated with the respective input test signals not shown in FIG. 8. These signals also can be used to display other information on the monitor.

Also illustrated in FIG. 8 are the vertical sync generator 46 and the horizontal timing circuitry 49. Vertical sync generator 46 examines row address register 42. If the two high order bits of that register have been set, vertical sync generator 46 generates the vertical retrace sequence from the timing patterns provided by horizontal timing circuitry 49. In addition, horizontal timing circuitry 49 generates horizontal sync signals for output pipeline 50, and the respective HPIX and clock/four timing signals for the line buffer circuitry. Horizontal timing circuitry 49 also generates additional signals which include the load signals for parallel-to-serial converter 48, row address register 42, and an output pipeline status register (not shown), as well as input and shift signals for the character and status input pipelines 40 and 41 respectively.

Also shown in FIG. 8 are a first set of registers 52, 53 and 57, and a second set of registers 55, 56 and 54. The purpose of these registers is to provide a pipelining feature for character code, status code and row addresses so that a sequence of such codes and addresses can be processed through the video output circuitry in a pipelined fashion. That is to say, as the character font signals are received by register 55 from character font ROM 53, the font select information is received by register 56 and the row address information is received by register 54. Also at this time, character codes to address the character font ROM 43 for the next character row are received by register 52 from character code input pipeline 40, status code is received by register 53 from status code input pipeline 41, and the row addresses are received by register 57 from row address register 52. Furthermore, during this time, new codes and addresses for still the next character row are being supplied to the respective input pipelines 40 and 41 and row address register 42.

As was indicated above, one of the features of the present invention is the provision of "nice" logic 47 in FIG. 8 which detects the occurrence of "included" corners with the result that no more storage of informational bits is required to produce the result of FIG. 2C than is required to produce the result of FIGS. 2A or 2B. With the present invention and also the above-referred-to Seitz et al U.S. Pat. No. 4,119,954, each character is processed "on the fly" as the character information comes out of character font ROM 43 by way of register 55 of FIG. 8.

To obtain characters like the one of FIG. 2C, i.e., with the "included" corners filled in, the additional information required is called the secondary character information. To this end, character font ROM 43 is divided into two sections, one for odd rows and one for even rows. For odd lines in the character it is required to know what the previous line of the character consisted of; and for even lines, it is necessary to know what the next line of the character will be. This knowledge is sufficient information to determine if "included" corners will occur. For example, for the nth row of the primary character information, that ROM is addressed that contains the row number which is an integer part of n/2, Row int (n/2), which may be in either the even or odd section of character font ROM 43. Then the additional information has to come from the other ROM since it is the Row int (n/2)+1 (mod.16) or Row int (n/2)−1 (mod.16), where 16 is the number of rows in the original character (8×16). Once the information about the two lines has been provided, then it is possible for logic circuitry 47 of FIG. 8 to fill in the "included" corners.

The algorithm of the steps employed by logic circuitry 47 in the present invention can be formulated in the following manner. Assume that the primary character information comes in an eight-bit parallel form out of one section of character font ROM 43 as bits $a_7$ through $a_0$; and that the secondary character information comes from the other section of the ROM, also in an eight-bit parallel form as $b_7$ through $b_0$. These signals are to be combined by logic circuitry 47 to produce an output therefrom in a 16-bit parallel form, $c_{15}$ through $c_0$ where $c_i$, for $i=0,1\ldots,15$, will be represented by the following equations:

$$C_{2N}=a_N+a_{N-1}b'_{N-1}b_N$$

$$C_{2N+1}=a_N+a_{N+1}b'_{N+1}b_N$$

For $2^{\circ}2N+1<15$ with the boundary conditions being $C_0=C_1=O$ and $C_{15}=a_7$.

The algorithm described above is useful in display of characters for all display monitors. The size of the character is not a parameter in the algorithm. As a result, the algorithm can be applied to any size characters. The algorithm can be expressed in a more general manner, however. Whenever characters are to be displayed in a finer resolution than the one in which they are stored, independent of the medium of the display, this algorithm can be applied to smooth out the appearance of those characters.

Figure 9:
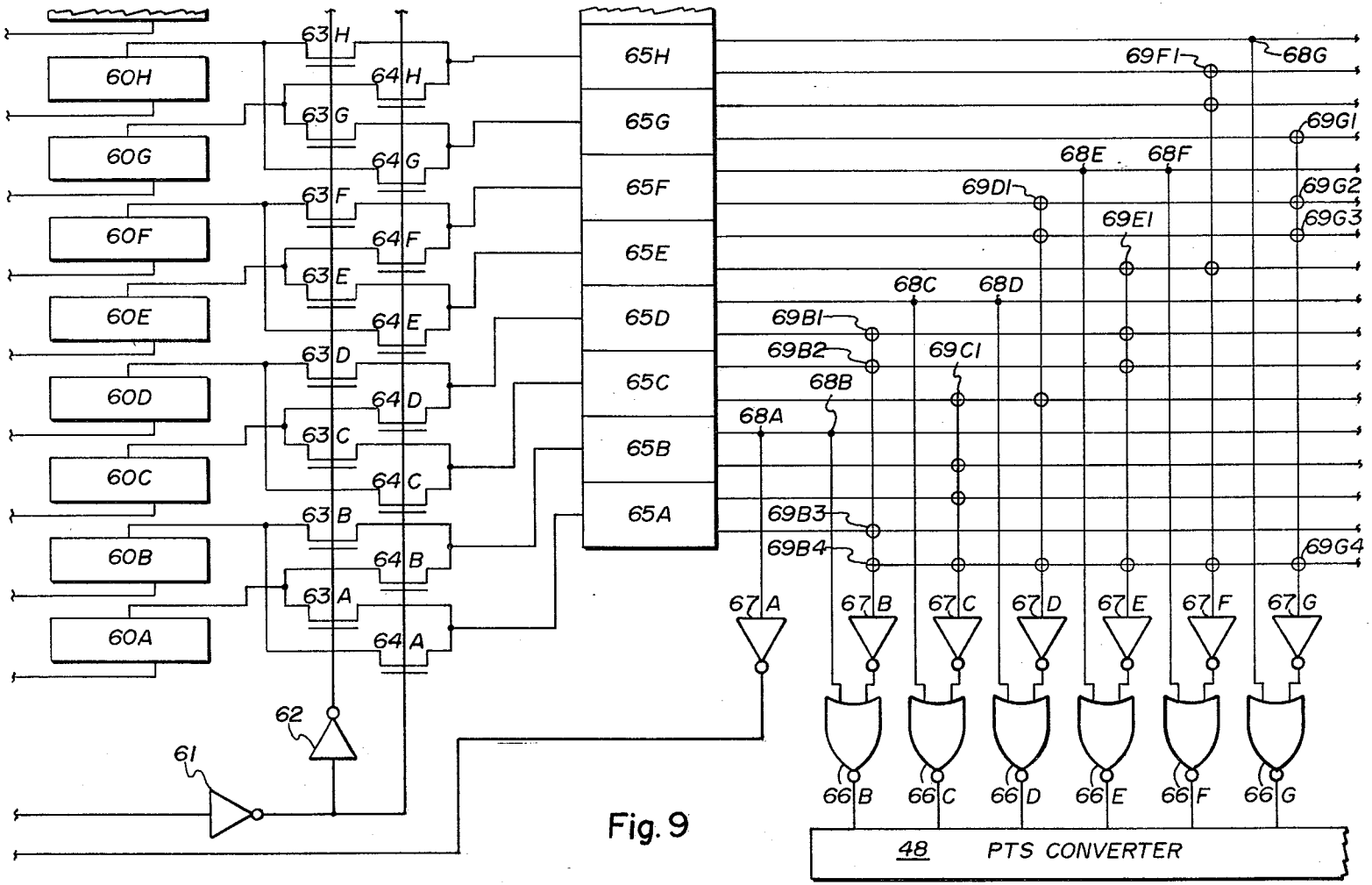
FIG. 9 is a schematic diagram of the nice character generator of FIG. 8.

"Nice" logic circuitry 47 for the generation of this type of characters is illustrated in part in FIG. 9. FIG. 9 illustrates only a portion of the circuitry that would be required to provide the full 16-bit output. However, it will be appreciated that sufficient circuitry for generating the first seven output bits is illustrated for the purpose of implementing the above-described equations.

In FIG. 9, the respective character font signals from character font ROM 43 of FIG. 8 are received by the set of latches 60A . . . H where latches 60A, 60C, and so forth, receive bits from the odd section of the character font ROM; and latches 60B, 60D and so forth receive bits from the even section of the character font ROM. Depending upon whether the current row for which character signals are being generated is odd or even, the signals stored in the respective latches 60A . . . H are gated out by either gates 64A . . . H or gates 63A . . . H respectively to the selection matrix line drivers 65A . . . H. That is to say, line drivers 65B, 65D, and so forth, always present primary information signals as well as the inverse signals thereof; while line drivers 65A, 65C, and so forth, always supply the secondary information.

The above-described equations for the respective rows are implemented by the matrix of FIG. 9. For example, primary signals for the respective output bits to be generated for the row are supplied to the network's output circuitry gates 68A, 68B . . . 68G. Because of the boundary conditions specified above, the bits $C_0$ and $C_1$ are read out directly by way of inverter 67A and NOR gate 66A. When the "nice" character feature is not implemented by way of an enable signal to gates 69B . . . G, only primary information will be provided. When the "nice" character feature is enabled by an appropriate signal to enabling gates 69B4 . . . 69G4, then the secondary information is also supplied to the respective NOR gates 66B . . . 66G. This secondary information, for example, for $C_2$, is provided by gates 69B1 . . . B3 when enable gate 69B4 is provided with an enable signal. The respective output signals are then supplied to parallel-to-serial converter 48 of FIG. 9 and FIG. 8.

EPILOGUE

A video output circuit has been disclosed for high resolution character generation in a digital display unit. This output circuitry includes both character generation circuits and logic circuits, the latter of which fills in information bit areas adjacent to character bit areas which form a diagonal so as thereby to round out the character being displayed. In addition, the circuitry is adapted to change the position of such characters on the display screen so as to provide superscripts and subscripts as well as provide characters which are higher and wider than the normal character display. In order to minimize time lags in the generation display of such characters, the output circuitry is provided with a series of registers so that the character generation can be received in a sequential or pipelined manner.

While but one embodiment of the present invention has been disclosed, it will be apparent to those skilled in the art that variations and modifications may be made therein without departing from the spirit and scope of the invention as claimed.

What is claimed is:

1. A system for displaying characters in a dot-matrix form, said system comprising:

a display unit having a display face and means to scan said display face in an interlaced scan mode;

storage means to store information signals representative of characters to be displayed, said storage means including a first store to hold information signals for even lines of the display and a second store to hold information signals for odd lines of the display, which even and odd lines are to be displayed in said interlaced scan mode;

logic means coupled to said display unit and to said storage means to receive information signals from both of said first store and said second store and to generate extra bit signals for display during the particular scan being displayed whenever the information signals to be displayed form a diagonal;

output buffering means including a register coupled to said logic means to receive said information signals and said extra bit signals to be transmitted to said display unit;

input buffering means including a register coupled to said storage means to receive a character code representing a character to be displayed, said character code forming an address to said storage means;

first register means coupled between said storage means and said logic means for receiving said information signals from said storage means; and second register means between said input buffering means and said storage means to receive said character code from said input buffering means at the same time said first register means is receiving said information signals from said storage means for the first preceding character code received by said first register means.

2. A system according to claim 1 wherein:

said logic means includes circuitry to generate signals according to the Boolean expressions:

$$C_{2N}=a_N+a_{N-1}b'_{N-1}b_N$$

$$C_{2N}=a_N+a_{N+1}b'_{N+1}b_N$$

where the C's represent the output signals to be generated, the a's represent the information signals from the first store, and the b's represent information signals from the second store.

3. A system according to claim 1 further including:

row address means to specify a row in said character line during said interlaced scan in which said information bits are to be displayed.

4. A system according to claim 3 wherein:

said row address means is adapted to provide a different row for display of said information bits other than said row in which previous character information bits were displayed.

5. A system according to claim 4 wherein:

said row address means provides a row address that represents a higher row of said display to display characters as superscripts.

6. A system according to claim 4 wherein:

said row address means provides a row address that represents a lower row of said display to display characters as subscripts.

7. In a system for the display of characters in a dot-matrix form, said system including a display unit, a row address register and storage means to store information signals representative of characters to be displayed, said storage means including a first store to store information signals for even lines of the display and a second store to store information signals for odd lines in the display, said storage means further including an input register and output register, said input register receiving addresses to address such storage means, the method comprising:

retrieving information signals from said storage means in response to the first preceding address and storing them in said output register at the same time said input register receives a new address to access the next set of information signals to be displayed;

generating extra bit signals for the display whenever the information signals to be displayed form a diagonal; and displaying said even and odd lines in interlaced scans.

8. A method according to claim 7 further including generation of signals according to the Boolean expressions:

$$C_{2N}=a_N+a_{N-1}b'_{N-1}b_N$$

$$C_{2N+1}=a_N+a_{N+1}b'_{N+1}b_N$$

where the C's represent the output signals to be generated, the a's represent the information signals from the first store, and the b's represent information signals from the second store.

9. A method according to claim 8 further including:

provision of a different row address for display of said information bits other than said row in which previous character information bits were displayed.

10. A method according to claim 9 further including:

provision of a row address that represents a lower row of said display to display characters as subscripts.

* * * * *